US006957554B2

(12) United States Patent
Saravanabhavan et al.

(10) Patent No.: US 6,957,554 B2
(45) Date of Patent: Oct. 25, 2005

(54) DEHAIRING AND FIBER OPENING PROCESS FOR COMPLETE ELIMINATION OF LIME AND SODIUM SULFIDE

(75) Inventors: Subramani Saravanabhavan, Chennai (IN); Palanisamy Thanikaivelan, Chennai (IN); Jonnalagadda Raghava Rao, Chennai (IN); Balachandran Unni Nair, Chennai (IN); Thirumalachari Ramasami, Chennai (IN)

(73) Assignee: Council of Scientific and Industrial Research, New Delhi (IN)

( * ) Notice: Subject to any disclaimer, the term of this patent is extended or adjusted under 35 U.S.C. 154(b) by 87 days.

(21) Appl. No.: 10/717,035

(22) Filed: Nov. 18, 2003

(65) Prior Publication Data

US 2005/0102761 A1 May 19, 2005

(51) Int. Cl.[7] ..... C14B 19/00
(52) U.S. Cl. ..... 69/21
(58) Field of Search ..... 69/21, 22, 23, 69/24, 28; 8/94.1 R, 94.14, 94.15, 94.16, 94.17, 94.18, 94.2; 252/8.57, 188.2; 435/265, 262, 221, 263, 68.1

(56) References Cited

U.S. PATENT DOCUMENTS 3,254,938 A * 6/1966 Rodriguez et al. ..... 8/94.27
3,986,926 A * 10/1976 Monsheimer et al. ..... 435/265
4,175,922 A 11/1979 Eckert et al.
4,294,087 A * 10/1981 Monsheimer et al. ..... 69/21
4,484,924 A * 11/1984 Pfleiderer et al. ..... 8/94.17
4,960,428 A * 10/1990 Christner et al. ..... 8/94.18
5,834,299 A * 11/1998 Andersen ..... 435/265
5,885,302 A * 3/1999 Leuck ..... 8/94.19 R
5,900,027 A * 5/1999 Geihsler et al. ..... 8/94.19 R
6,708,531 B1 * 3/2004 Thanikaivelan et al. ..... 69/21

* cited by examiner

*Primary Examiner*—Gary L. Welch
(74) *Attorney, Agent, or Firm*—Christie, Parker & Hale, LLP

(57) ABSTRACT

The use of lime and sodium sulfide in leather making creates a lot of environmental concern. However, there is no commercial beam house process that could totally eliminate the use of lime and sodium sulfide. In this invention, a novel bio-chemical process has been standardized employing specific enzymes and non-toxic chemical that could totally eliminate the use of lime and sodium sulfide in leather processing. It has been found that the extent of hair removal and opening up of fiber bundles is comparable to that of the conventional limed leathers. Performance of the leathers is shown to be on par with conventionally leathers. The process also enjoys reduction in chemical oxygen demand and total solids load compared to conventional process.

17 Claims, 1 Drawing Sheet

Figure 1:
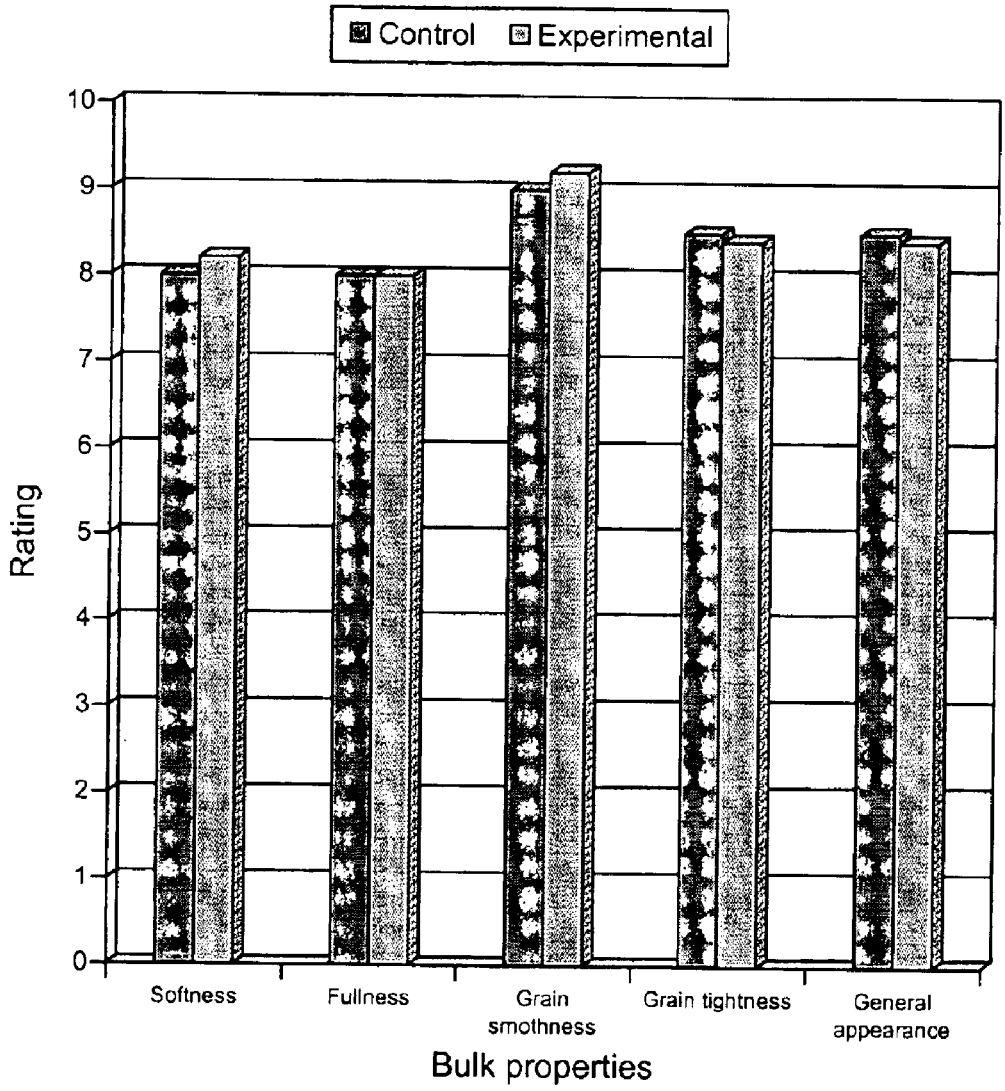

DEHAIRING AND FIBER OPENING PROCESS FOR COMPLETE ELIMINATION OF LIME AND SODIUM SULFIDE

FIELD OF THE INVENTION

The present invention relates to a novel dehairing and fibre opening process for complete elimination of lime and sodium sulfide. More particularly, the present invention provides an improved process for making pelt by dehairing and fibre opening employing enzyme and non-toxic silicate salt. The process has enormous potential application in tanning industry for processing hides/skins in an eco-benign way without adding to pollution load.

BACKGROUND AND PRIOR ART REFERENCES

Conventional leather processing involves four important operations, viz., pre-tanning, tanning, post tanning and finishing. It includes a combination of single and multi-step processes that employs as well as expels various biological, organic and inorganic materials as described by Germann (Science and Technology for Leather into the Next Millennium, Tata McGraw-Hill Publishing Company Ltd., New Delhi, p. 283, 1999). Beam house processes (liming and reliming) employ lime and sodium sulfide and purifies the skin matrix by the removal of hair, flesh and other unwanted materials. Various application methods include pit, paddle, drum and painting on flesh side. After this stage, the hide/skin is termed as pelt. Deliming, bating and pickling processes prepare the skin for subsequent tanning. Tanned skin matrix further retanned to gain substance, fatliquored to attain required softness and dyed to preferred shades.

Generally, liming-reliming process liquors contribute to 50–70% of the total biochemical oxygen demand (BOD) and chemical oxygen demand (COD) load from a tannery waste-water and 15–20% in the case of total solids (TS) load as reported by Aloy et al (Tannery and Pollution, Centre Technique Du Cuir: Lyon, France, 1976). Apart from this, a great deal of solid wastes containing lime sludge, fleshings, and hair are generated. The extensive use of sulfide bears unfavorable consequences on environment and the efficacy of effluent treatment plants as reported by Colleran et al (Antonie van Leeuwenhoek, 67, 29, 1995).

Several lime and sulfide free liming methods have evolved during the past century. Bose and Dhar (Leather Science, 2, 140, 1955; 21, 39, 1974) have reviewed the use of enzymes such as proteolytic, amylolytic, etc from various sources namely animal, mold, bacterial and plant for dehairing hides and skins. However, these methods include the use of lime. Rosenbusch (Das Leder, 16, 237, 1965) has reported the use of chlorine dioxide for dehairing. Morera et al (Journal of the Society of Leather Technologists and Chemists, 81, 70, 1997) have studied the use of hydrogen peroxide in alkaline medium for dehairing by oxidation mechanism. However, the reduction in pollution load especially COD is not significant. Sehgal et al (Journal of the Society of Leather Technologists and Chemists, 80, 91, 1996) have developed a non-enzymatic sulfide free dehairing process using 1% nickel carbonate, 1% sodium hydroxide, 5% lime and kaolin along with water by painting. However, disposal or recovery of nickel compounds poses serious health problems. Schlosser et al (Journal of the Society of Leather Technologists and Chemists, 70, 163, 1986) have reported the use of lacto-bacillus based enzymes at acidic conditions for dehairing. This method leads to the solubilisation of collagen at the experimental conditions. Valeika et al (Journal of the Society of Leather Technologists and Chemists, 81, 65, 1997; 82, 95, 1998) have attempted to replace lime for dehairing using sodium hydroxide and sodium sulfide. They also found that the addition of salts such as sodium chloride, sodium sulfate, sodium formate or sodium hydrogen phosphate influence the extent of hair removal as well as opening up of the dermis structure. Commercial application of these methods is not popular in the global leather sector. Thanikaivelan et al (Journal of the Society of Leather Technologists and Chemists 84, 276, 2000) have developed a lime free enzymatic dehairing process along with reduced amount of sodium sulfide, which ensures complete dehairing within 18 hrs. However, enzyme-assisted lime-sulfide dehairing is being followed in some parts of the world. All the methods are applicable for only dehairing of skins/hides in leather processing. The dehaired pelts require fibre opening. Conventionally the fibre opening is obtained by treatment with lime through osmotic swelling.

Liming removes all the interfibrous materials especially proteoglycans and produces a system of fibres and fibrils of collagen which are clean as described by Campbell et al (Journal of American Leather Chemists Association, 68, 96, 1973). This is achieved by the alkali action as well as osmotic pressure built up in the skin matrix. Thanikaivelan et al (Environmental Science & Technology, 36, 4187, 2002) have successfully developed lime free fibre opening process employing x-amylase. However, no successful attempt has been made to eliminate lime and sodium sulfide completely in leather processing.

In our earlier application PCT/N03/00074, we have shown a novel process for an unhairing process using animal and/or herbal enzymes. The claimed process provides with a dime-sulphide free process for unhairing. The previously claimed method was restricted in the pH range of 4.0–10.0. In addition, the effect of use of silicate salt was not discussed and other parameters, which distinguishes our present work from the previous work. For example, identification and use of different enzymes and silicate salts for forming the paste and comparative study of the present invention with respect to the conventional lime-sulphide process. The present invention also makes an attempt to make a comparison between the quality of leather in the conventional method and present case.

Silicates have been widely used in various industrial applications for a long time. In leather manufacture, by contrast, the silica compounds have so far been of only minor importance. Wet-white tanning agent based on sodium aluminium silicate has been reported by Zauns and Kuhm (Journal of American Leather Chemists Association, 90, 177, 1995). Silicon dioxide based tanning system has been established by Fuchs and Kupfer (Journal of American Leather Chemists Association, 90, 164, 1995). Recently, Kanagaraj et al (Journal of American Leather Chemists Association, 95, 368, 2000) have developed a less salt preservation system based on silica gel and low amount of salt.

OBJECTS OF THE INVENTION

The main objective of the present invention is to provide a novel dehairing and fibre opening process for complete elimination of lime and sodium sulfide, which obviates the drawbacks stated above.

Another objective of the present invention is to provide a complete set of beam-house processes that employs only enzyme and non-toxic chemical.

Yet another objective of the present invention is to provide a bio-chemical based beam-house process that provides softer and smoother leathers.

Still another objective of the present invention is to provide a biochemical based beam-house process that leads to significant reduction in chemical oxygen demand and total solids load.

Yet another objective of the present invention is to provide a lime and sodium sulfide free beam-house process that totally obviates the formation of dry sludge.

BRIEF DESCRIPTION OF THE FIGURES AND TABLES

Table 1: Comparative data on various environmental and economic parameters

FIG. 1: Evaluation data for leathers obtained from conventional method and present invention

DETAILED DESCRIPTION OF THE INVENTION

Accordingly, the present invention provides a novel dehairing and fibre opening process for complete elimination of lime and sodium sulfide, which comprises i) adding 5–10% w/w, based on the weight of soaked hides/skins, of water to 0.5–1.5% w/w, based on the weight of soaked hides/skins, of proteolytic enzyme, exhibiting optimum activity at pH 7.5–11.0 and temperature 25–40° C., optionally in the presence of not more than 1.5% w/w, based on the weight of soaked hides/skins, of silicate salt, to prepare a paste, ii) applying the paste, as formed in step (i), on the flesh or grain side of the hides/skins by known method, iii) piling the pasted hides/skins grain to grain for a period of not less than 12 hours followed by removing the hair by known method to get dehaired hides/skins, iv) treating the dehaired hides/skins, as obtained in step (iii), with 5–10% w/w, based on the weight of dehaired hides/skins, of silicate salt in presence of 50–250% w/w of water, preferably under stirring condition, for a period of not less than 3 hrs, followed by fleshing by known method to get pelt for subsequent post fibre opening processes.

In an embodiment of the present invention, the proteolytic enzyme used may be selected from bacterial protease, fungal protease, either individually or in any combination.

In another embodiment of the present invention, the silicate salt used may be selected from sodium metasilicate, water glass, sodium orthosilicate, either individually or in combination.

The process of the present invention is described below in detail.

A dehairing paste is prepared by mixing proteolytic enzyme in the range of 0.5–1.5% w/w, on the weight of soaked skins or hides with 5–10% w/w of water on the weight of soaked skins or hides, optionally in the presence of not more than 1.5% w/w of silicate salt. The dehairing paste, thus prepared is applied on the flesh or grain side of the soaked skins or hides by known manual or mechanical method and the pasted hides/skins are piled grain to grain for a period of not less than 12 hrs. The skins or hides are then dehaired by conventional method.

The dehaired skins or hides are mixed with 50–250% w/w of water on the weight of dehaired skins or hides and treated with 5–10% w/w of silicate salt on the weight of dehaired skins or hides preferably under stirring condition, for a period of not less than 3 hrs followed by fleshing by known method to get pelt for subsequent post fibre opening processes.

The novelty and non obviousness of the present development lies in using proteolytic enzymes and non-toxic silicate salt for dehairing and fibre opening, thereby providing an eco-benign bio-chemical based beam house process that totally eliminates the use of lime and sodium sulfide.

The applicant have compared the various pollution parameters, time, water and power requirement between the conventional and novel dehairing and fibre opening processes in accompanying Table 1. The softness and other bulk properties have been compared by hand and visual examination and the rating are given in accompanying FIG. 1.

TABLE 1

| S1. No. | Parameters | Conventional lime-sodium sulfide process | Novel lime-sodium sulfide free process |
|---|---|---|---|
| 1. | Dry sludge formation | 120–150 kg/t of raw skins/hides | No dry sludge formed |
| 2. | Total solids load | 100–200 kg/t of raw skins/hides | 50–120 kg/t of raw skins/hides |
| 3. | COD load | 40–100 kg/t of raw skins/hides | 20–60 kg/t of aw skins/hides |
| 4. | Time requirement | 3–5 days | 1–3 days |
| 5. | Water requirement | 4–8 l/kg of raw skins/hides | 2–3 l/kg of raw skins/hides |
| 6. | Power requirement | 50–100 kWh | 15–45 kWh |
| 7 | Toxicity | Sodium sulfide is highly toxic | Enzyme and silicate salts are not toxic. |

The invention is described in detail in the following examples, which are provided by way of illustration only and therefore should not be construed to limit the scope of the present invention.

EXAMPLE 1

Three wet salted goatskins, weighing 2.8 kg, were soaked in 8.4 lit water for 2 hrs in a pit. Then the skins were again soaked in 8.4 lit fresh water for 2 hrs. The soaked skins were drained to remove surface water and the weight was found to be 3 kg. 30 gms Biodart (alkaline bacterial protease from Southern Petrochemical Industries Corporation (SPIC) Limited, Chennai, India) and 30 gms sodium metasilicate were mixed in 180 ml water to form a paste. The prepared paste was applied on the flesh side of the goatskins and piled flesh side of one skin to flesh side of the other and left undisturbed for 12 hrs. The skins were then dehaired using conventional beam and blunt knife technique. Weight of the dehaired skins was found to be 2.1 kg.

The dehaired goatskins were loaded in a drum with 4200 ml water. To this, 105 gms sodium orthosilicate was added to the drum. The duration of treatment was one day with 5 min running per hour for 6 hrs and left overnight in the bath. The bath was drained off and the skins were scudded using conventional beam and blunt knife technique and fleshed in a hydraulic fleshing machine. Weight of the pelts was found to be 2.8 kg. The resultant pelts were taken for further processing.

EXAMPLE 2

Three dry salted sheepskins, weighing 4.7 kg, were soaked in 14.1 lit water for 3 hrs in a pit. Then the skins were again soaked in 14.1 lit fresh water for 3 hrs. The soaked skins were drained to remove surface water and the weight was found to be 6 kg. 30 gms Biodart (alkaline bacterial protease from Southern Petrochemical Industries Corporation (SPIC) Limited, Chennai, India) was mixed in 300 ml water along with 90 gms sodium orthosilicate to form a paste. The prepared paste was applied on the flesh side of the sheepskins and piled flesh side of one skin to flesh side of the other and left undisturbed for 12 hrs. The skins were then dehaired using conventional beam and blunt knife technique. Weight of the dehaired skins was found to be 3.6 kg.

The dehaired skins were loaded in a drum with 7200 ml water. To this, 180 gms sodium metasilicate was added to the drum. The duration of treatment was one day with 5 min running per hour for 6 hrs and left overnight in the bath. The bath was drained off and the skins were scudded using conventional beam and blunt knife technique and fleshed in a hydraulic fleshing machine. Weight of the pelts was found to be 4.5 kg. The resultant pelts were taken for further processing.

EXAMPLE 3

Four green cow sides, weighing 23 kg, were soaked in 69 lit water for 2 hrs in a pit. The soaked sides were drained to remove surface water and the weight was found to be 24 kg. 240 gms Biodart (alkaline bacterial protease from Southern Petrochemical Industries Corporation (SPIC) Limited, Chennai, India) and 120 gms Erhavit MC (alkaline fungal protease from Together For Leather (TFL), Germany) were mixed in 2400 ml water along with 360 gms water glass to form a paste. The prepared paste was applied on the grain side of the cow sides and piled grain side of one side to grain side of the other and left undisturbed for 18 hrs. The sides were then dehaired using conventional beam and blunt knife technique. Weight of the dehaired sides was found to be 20 kg.

The dehaired sides were loaded in a drum with 50000 ml water. To this, 2 kg sodium metasilicate was added and the drum was run for 5 min per hour for 6 hrs and left overnight in the bath. The bath was drained off and the sides were scudded using conventional beam and blunt knife technique and fleshed in a hydraulic fleshing machine. Weight of the pelts was found to be 25 kg. The resultant pelts were taken for further processing.

EXAMPLE 4

Four green cow sides, weighing 23 kg, were soaked in 69 lit water for 2 hrs in a pit. The soaked sides were drained to remove surface water and the weight was found to be 24 kg. 240 gms Biodart (alkaline bacterial protease from Southern Petrochemical Industries Corporation (SPIC) Limited, Chennai, India) and 120 gms Microdep C (alkaline bacterial protease from Textan Chemicals Private Limited, Chennai, India) were mixed in 2400 ml water along with 360 gms water glass to form a paste. The prepared paste was applied on the grain side of the cow sides and piled grain side of one side to grain side of the other and left undisturbed for 18 hrs. The sides were then dehaired using conventional beam and blunt knife technique. Weight of the dehaired sides was found to be 20 kg.

The dehaired sides were loaded in a drum with 50000 ml water. To this, 2 kg sodium metasilicate was added and the drum was run for 5 min per hour for 6 hrs and left overnight in the bath. The bath was drained off and the sides were scudded using conventional beam and blunt knife technique and fleshed in a hydraulic fleshing machine. Weight of the pelts was found to be 25 kg. The resultant pelts were taken for further processing.

EXAMPLE 5

Three dried buffcalfs, weighing 17 kg, were soaked in 51 lit water for 3 hrs in a pit. Then the skins were again soaked in 51 lit fresh water for 4 hrs with 17 gms wetting agent. The soaked calfs were drained to remove surface water and the weight was found to be 22 kg. 220 gms Biodart (alkaline bacterial protease from Southern Petrochemical Industries Corporation (SPIC) Limited, Chennai, India) and 220 gms water glass were mixed in 1540 ml water to form a paste. The prepared paste was applied on the grain side of the calfs and piled grain side of one calf to grain side of the other and left undisturbed for 18 hrs. The calfskins were dehaired using conventional beam and blunt knife technique. Weight of the dehaired calfs was found to be 18 kg.

The dehaired calfs were loaded in a drum with 36000 ml water. To this, 360 gms water glass, 900 gms sodium metasilicate and 180 gms sodium orthosilicate were added to the drum. The duration of treatment was one day with 5 min running per hour for 6 hrs and left overnight in the bath. The bath was drained off and the calfskins were scudded using conventional beam and blunt knife technique and fleshed in a hydraulic fleshing machine. Weight of the pelts was found to be 23 kg. The resultant pelts were taken for further processing.

EXAMPLE 6

Three wet salted goatskins, weighing 2.8 kg, were soaked in 8.4 lit water for 2 hrs in a pit. Then the skins were again soaked in 8.4 lit fresh water for 2 hrs. The soaked skins were drained to remove surface water and the weight was found to be 3.2 kg. 32 gms Biodart (alkaline bacterial protease from Southern Petrochemical Industries Corporation (SPIC) Limited, Chennai, India) and 16 gms Microdep C (alkaline bacterial protease from Textan Chemicals Private Limited, Chennai, India) were mixed in 160 ml water to form a paste. The prepared paste was applied on the flesh side of the goatskins and piled flesh side of one skin to flesh side of the other and left undisturbed for 12 hrs. The skins were then dehaired using conventional beam and blunt knife technique. Weight of the dehaired skins was found to be 2.2 kg.

The dehaired goatskins were loaded in a drum with 1100 ml water. To this, 132 gms sodium metasilicate was added to the drum. The drum was run for 20 min per hour for 3 hrs. The bath was drained off and the skins were scudded using conventional beam and blunt knife technique and fleshed in a hydraulic fleshing machine. Weight of the pelts was found to be 2.9 kg. The resultant pelts were taken for further processing.

EXAMPLE 7

Four freezed cow sides, weighing 24 kg, were soaked in 72 lit water for 3 hrs in a pit. The soaked sides were drained to remove surface water and the weight was found to be 25 kg. 250 gms Biodart (alkaline bacterial protease from Southern Petrochemical Industries Corporation (SPIC) Limited, Chennai, India) and 250 gms sodium metasiliacte were mixed in 1750 ml water to form a paste. The prepared paste was applied on the grain side of the cow sides and piled grain side of one side to grain side of the other and left undisturbed for 18 hrs. The sides were then dehaired using conventional beam and blunt knife technique. Weight of the dehaired sides was found to be 20 kg.

The dehaired sides were loaded in a drum with 50000 ml water. To this, 1.6 kg sodium orthosiliacte and 400 g sodium metasilicate were added and the drum was run for 20 min per hour for 10 hrs. The bath was drained off and the sides were scudded using conventional beam and blunt knife technique and fleshed in a hydraulic fleshing machine. Weight of the pelts was found to be 26 kg. The resultant pelts were taken for further processing.

EXAMPLE 8

Three dry salted sheepskins, weighing 5.0 kg, were soaked in 15 lit water for 3 hrs in a pit. Then the skins were again soaked in 15 lit fresh water for 3 hrs. The soaked skins were drained to remove surface water and the weight was found to be 6.2 kg. 62 gms Biodart (alkaline bacterial protease from Southern Petrochemical Industries Corporation (SPIC) Limited, Chennai, India) was mixed in 372 ml water along with 46.5 gms sodium metasilicate to form a paste. The prepared paste was applied on the flesh side of the sheepskins and piled flesh side of one skin to flesh side of the other and left undisturbed for 12 hrs. The skins were then dehaired using conventional beam and blunt knife technique. Weight of the dehaired skins was found to be 3.8 kg.

The dehaired skins were loaded in a drum with 3800 ml water. To this, 76 gms sodium metasilicate and 114 gms sodium orthosilicate were added to the drum. The total duration of treatment was 20 min running per hour for 3 hrs. The bath was drained off and the skins were scudded using conventional beam and blunt knife technique and fleshed in a hydraulic fleshing machine. Weight of the pelts was found to be 4.8 kg.

The resultant pelts were taken for further processing.

The following are the advantages of the present invention:

1. This process hardly requires any complicated control measures.
2. It completely eliminates the formation of dry sludge.
3. Provides significant reduction in total solids and chemical oxygen demand.
4. The process leads to significant reduction in time, power and water.
5. Provides rationalization of fibre opening processes.
6. Suitable for all kinds of raw materials.
7. The product produces soft and supple leathers.
8. Cheaper and commercially available chemicals and enzymes are used for the process of the present invention.
9. Provides an easy means for splitting the thick hide after fibre opening.
10. Pelts are easy to handle after fibre opening.

We claim:

1. A novel dehairing and fibre opening process for complete elimination of lime and sodium sulfide suitable for all kind of raw materials, comprising:

i. adding water in an amount from about 5% to about 10% w/w, with respect to the weight of soaked hides/skins, and proteolytic enzyme, exhibiting activity at a temperature from about 25° C. to about 400° C. and a pH from about 7.5 to about 11.0, optionally in the presence of silicate salt, to prepare a paste, ii. applying the paste, as formed in step (i), on the flesh or grain side of the hides/skin, iii. piling the pasted hides/skins, grain to grain, for a period of not less than 12 hours followed by removing the hair to get dehaired hides/skins, iv. treating the dehaired hides/skins, as obtained in step (ii), with silicate salt in presence of water, preferably under stirring condition, for a period of not less than 3 hrs, followed by fleshing to get pelt for subsequent post fibre opening processes.

2. A process as claimed in claim 1, wherein the raw materials are selected from the group comprising of skins and hides of goat, sheep, cow and buffalo.

3. A process as claimed in claim 1, wherein addition of the proteolytic enzyme in step (i) is in the range of 0.5–1.5% w/w, with respect to weight of soaked hides/skin.

4. A process as claimed in claimed in claim 1, wherein addition of the silicate salt in step (i) is in the range of 0–1.5%, with respect to weight of soaked hides/skin.

5. A process as claimed in claim 1, wherein addition of silicate salt in step (iv) is in the range of 5–10% w/w, with respect to the weight of waked hides/skin.

6. A process as claimed in claim 1, wherein addition of water in step (iv) is in the range of 50–250% w/w, with respect to the weight of soaked hides/skin.

7. A process as claimed in claim 1, wherein the soaked hides/skins are fleshed manually.

8. A process as claimed in claim 1, wherein the proteolytic enzyme used is selected from the group consisting of bacterial protease, fungal protease, and combinations thereof.

9. A process as claimed in claim 1, wherein the silicate salt used is selected from the group consisting of sodium metasilicate, water glass, sodium orthosilicate, and combinations thereof.

10. A process as claimed in claim 1, wherein the process eliminates the formation of dry sludge in the effluent.

11. A process as claimed in claim 1, wherein time required to complete the process of dehairing and fibre opening is 1 to 3 days.

12. A process as claimed in claim 1, wherein total solids load is in the range of 50 to 120 kg/t of raw skins/hides.

13. A process as claimed in claim 1, wherein total chemical oxygen demand load is in the range of 20 to 60 kg/t of raw skins/hides.

14. A process as claimed in claim 1, wherein the water required in the process is in the range of 2 to 3 l/kg of raw skins/hides.

15. A process as claimed in claim 1, wherein the power requirement in the process is in the range of 15 to 45 kWh.

16. A process as claimed in claim 1, wherein the process results in significant reduction in total solids and chemical oxygen demand in comparison to effluent derived from conventional dehairing processes.

17. A process as claimed in claim 1, wherein the process produces soft and supple leather.

* * * * *